United States Patent [19]

Atherton et al.

[11] Patent Number: 4,686,048

[45] Date of Patent: Aug. 11, 1987

[54] PROCESS FOR TREATING CAT CRACKER BOTTOMS SLUDGE

[75] Inventors: George A. Atherton, Baton Rouge, La.; Ghazi B. Dickakian, Greenville, S.C.; Edward D. Grant, Jr., Baton Rouge, La.

[73] Assignee: Exxon Research & Engineering Co., Florham Park, N.J.

[21] Appl. No.: 333,989

[22] Filed: Dec. 23, 1981

[51] Int. Cl.[4] ..... B01D 11/02

[52] U.S. Cl. ..... 210/771; 208/13; 210/772; 210/806

[58] Field of Search ..... 208/13; 210/771, 772, 210/778, 806; 134/40

[56] References Cited

U.S. PATENT DOCUMENTS

| | | | |
|---|---|---|---|
| 3,692,668 | 9/1972 | McCoy et al. | 208/13 X |
| 3,696,021 | 10/1972 | Cole et al. | 208/13 |
| 3,835,021 | 9/1974 | Lorenz et al. | 208/13 |
| 4,123,357 | 10/1978 | Clements et al. . | |
| 4,206,001 | 6/1980 | Knowlton . | |
| 4,260,489 | 4/1981 | Greig et al. | 208/13 X |

*Primary Examiner*—Frank Spear

*Attorney, Agent, or Firm*—M. D. Bittman; E. T. Wheelock

[57] ABSTRACT

A process is disclosed for treating cat cracker bottoms sludge to remove the cat cracker bottoms hydrocarbons from the catalyst fines in the sludge to provide treated fines which are environmentally safe for landfill. The process involves mixing the sludge with a hydrocarbon diluent, separating the fines from the diluent-sludge mixture, then mixing the separated fines and remaining diluent with water and distilling off the remaining diluent to obtain the treated fines.

16 Claims, No Drawings

PROCESS FOR TREATING CAT CRACKER BOTTOMS SLUDGE

BACKGROUND OF THE INVENTION

Catalytic cracking is a major conversion process in the petroleum industry. Within a catalytic cracking reactor a refinery fuel oil feedstock and an active catalytic agent are reacted under.heat to convert the fuel to produce lighter, more valuable products. Broadly speaking the heavy fuel feedstock contains mixtures of aromatic, naphthene and paraffin molecules with a common feed being a virgin gas oil, which is the part of the crude oil boiling between 600° F. and 1050° F. Cracking of the feedstock generally occurs in the reactor at temperatures within the range of about 890° F. to 1025° F. The spent catalyst is processed to regenerate it and to be recycled in the catalytic cracking process stream. The effluent from the catalytic cracking reactor is sent into a fractionator in which the gaseous, light oil and heavy oil products are separated. The cat cracker bottoms are the heaviest and highest boiling fractions and contain some catalysts fines which must be removed or reduced in level to allow for the cat cracker bottoms to be blended into a fuel oil or used as needle coke or carbon black feedstock.

A number of catalysts having a high activity which are satisfactory for commercial cracking may be used. The catalysts may be natural or synthetic, with the main types being amorphous and zeolitic. A common catalyst is a crystalline zeolite, or molecular sieve catalyst, which is generally impregnated on an amorphous clay or a silica-alumina base. Another common catalyst is an amorphous or noncrystalline type comprising alumina and silica, or alternatively silica and magnesia.

The cat cracker bottoms which contain the catalyst fines are commonly routed to a settling tank wherein the solid particles (catalyst fines) are allowed to settle by gravity with the upper layer of substantially fines-free cat cracker bottoms being decanted off for product use. Generally, the incoming stream of cat cracker bottoms contain an ash level of about 0.1 to 0.5% by weight and the level of fines must be reduced by at least 75% or greater to an ash level of less than 0.05% by weight for subsequent product use of the cat cracker bottoms. After settling, the resultant sludge containing the catalyst fines and the cat cracker bottoms hydrocarbons will generally have an ash content (fines level) on the order of 10 to 40% by weight and a cat cracker bottoms hydrocarbon level on the order of 60 to 90% by weight. The resultant sludge not only contains a large amount of useful cat cracker bottoms hydrocarbons, but presents difficult and expenseive disposal problems.

Another method of reducing the level of fines in the cat cracker bottoms is by dielectrophoretic separation, the resultant cat cracker bottoms sludge having an ash level on the order of 2 to 5% by weight.

Past practice involved transporting the sludge to landfarms, landfills or other disposal treatments. The landfarm process consists of controlled application and cultivation of waste on soil, on a properly engineered site, in order to use microbes naturally present in the soil to decompose the organic fraction of the waste. These past practices have been extremely time consuming and expensive, with the need being identified for a more efficient and environmentally safe process to be developed.

U.S. Pat. No. 4,123,357 discloses a process whereby oil, water, and the solids materials of the sludge are stirred at high temperatures of at least 95° F., followed by settling, decanting, settling and again decanting the upper layers which are substantially solid free. U.S. Pat. No. 4,206,001 discloses circulating a solvent with the sludge in the rundown tank, followed by decanting the solvent, then washing the settled solids with water, followed again by decanting the aqueous solution and hydrocarbons. While these procedures are effective in reducing the level of cat cracker bottoms on the solids, an alternative process is desirable which can more efficiently remove the cat cracker bottoms or other hydrocarbons from the catalyst fines and which is less time consuming.

Therefore, it is a feature of the present invention to provide a process which efficiently removes hydrocarbons from cat cracker bottoms sludge.

It is another feature of this invention to treat the catalyst fines of cat cracker bottoms sludge to provide vide an environmentally safe treated fine.

It is still a further feature of this invention to recover and isolate the cat cracker bottoms hydrocarbons from the cat cracker bottoms sludge.

SUMMARY OF INVENTION

Briefly, the features of this invention are carried out by treating cat cracker bottoms sludge to remove the cat cracker bottoms hydrocarbons from the catalyst fines in the sludge by mixing the cat cracker bottoms sludge with a hydrocarbon diluent having a boiling point when mixed with water of less than 212° F.; separating the fines from the diluent sludge mixture; mixing the separated fines and remaining diluent with water; and removing the remaining hydrocarbon diluent by distillation to obtain the treated fines. Preferably the separation processes are carried out by filtration.

DETAILED DESCRIPTION OF THE INVENTION

Within the catalytic cracking reactor, the heavy fuel oil feedstock is subjected to processing conditions of elevated temperature and sometimes elevated pressure, in the presence of a catalyst to accomplish the desired cracking. The resultant effluent of the reactor is then fractionated into the desired fractions of gaseous, light oils and heavy oils, with the heaviest and highest boiling fraction being the cat cracker bottoms which contain the catalyst fines. The term catalyst fines as used herein includes other solids, such as coke which may be coated on the catalyst.

The catalyst fines in the cat cracker bottoms are then concentrated to provide the cat cracker bottoms sludge. One method of concentrating the fines in the sludge is by settling the fines through the action of gravity and drawing off the upper (top-most) layer which contains the cat cracker bottoms hydrocarbons which are relatively free of solids (catalyst fines). In general, the resultant cat cracker bottoms sludge (lower layer) has an ash content within the range of 10% to 40% by weight, and a hydrocarbon content of 60% to 90% by weight, however, lower ash contents could also be effectively obtained by this process. An alternative method of concentrating the catalyst fines (solids) in the cat cracker bottoms sludge is dielectrophoretic separation of the solids. In general, this process results in an ash content in the sludge of about 2 to 5% by weight. The process of this invention for treating cat cracker bottoms sludge to remove the cat cracker bottoms hydrocarbons from the catalyst fines in the sludge can process sludge having a widely varying ash content, generally on the order of 1 to 40% by weight, preferably on the order of 10 to 40% by weight of the sludge.

The first step of the process of this invention involves mixing the cat cracker bottoms sludge with a hydrocarbon carbon diluent. This diluent should have a boiling point when combined with water of less than 212° F., i.e. either its boiling point is less than 212° F., or its azeotropic boiling point when combined with water is less than 212° F. Generally, this diluent should be compatible with the cat cracker bottoms hydrocarbons in the relative volumes used and able to dilute the same for subsequent separation of the cat cracker bottoms hydrocarbons from the catalyst fines. Generally, the diluent will be a liquid light hydrocarbon having a carbon content of $C_7$ or less. The diluent preferably has a boiling point when combined with water of 150° F. to 210° F. The above boiling point temperatures are interdependent with a process operating at atmospheric pressure. Higher or lower pressures could be utilized with the boiling point temperatures being adjusted accordingly. Preferred diluents which azeotropically distill with water include n-heptane (azeotropic boiling point of 182° F.), benzene (azeotropic boiling point of 156° F.) and toluene (azeotropic boiling point of 183° F.). Other diluents include n-hexane, methylhexane, ethylpentane, dimethylpentane, trimethylbutane, hexene, heptene, methylcyclopentane, cyclohexane, dimethylcyclopentane and methylcyclopentadiene, with the preferred classes being pentane, hexane and heptane. Blends of the above diluents may also be employed.

The sludge is mixed with an amount of diluent effective to dilute the hydrocarbons and effectively withdraw the cat cracker bottoms hydrocarbons upon subsequent separation. Generally, the amount of diluent is within the range of 50% to 500% by weight, preferably 50% to 150% by weight of the cat cracker bottoms hydrocarbons in the sludge. The sludge and diluent are mixed at a temperature below the boiling point of the diluent, preferably within the range of 100° F. to 210° F. to maintain the sludge flowable.

The next step involves separating the fines from the diluent-sludge mixture. This separation may be carried out by a number of means including the use of centrifuges, settling tanks or cyclones, but preferably the separation is carried out by filtration. At this stage, it is preferable to wash the cake (separated fines) with additional diluent to effectively remove substantially all of the cat cracker bottom hydrocarbons remaining in the cake (separated fines). The amount of additional diluent is generally within the range of 20% to 500% by weight of the cat cracker bottoms hydrocarbons in the original sludge. Additionally, gas such as nitrogen may be forced through the cake to force off excess diluent. A separation aid may be added to the diluent-sludge mixture to accelerate the separation of the fines. For example, a filtration aid such as diatomaceous slica, aluminum alkali silicate, fuller's earth, magnesia or cellulose fiber may be added. The liquid fraction separated from the fines contains the cat cracker bottoms and diluent.

The separated fines and remaining diluent (cake) are then mixed with water. The separated fines and remaining diluent can be mixed with liquid water to form a slurry, with the amount of water being generally within the range of 100% to 1500% by weight, preferably 250% to 700% by weight of the separated fines and remaining diluent (cake). The mixing of the slurry is carried out at a temperature below the boiling point of the diluent when combined with water, preferably within the temperature range of ambient to 210° F. An antifoaming agent such as a high molecular weight polyhydric alcohol, polyamide, silicone, organic phosphate or aliphatic ester may be added to the slurry to prevent foaming of the slurry during distillation. Alternatively the separated fines and remaining diluent can be mixed with water in the form of steam, which beneficially additionally provides the energy needed to distill off the remaining diluent while adding liquid water to the fines by condensation of the stream. The amount of steam is generally within the range of 3% to 25%, preferably 5% to 15%, by weight of the separated fines and remaining diluent (cake).

The separated fines, remaining diluent and water are subjected to distillation to remove the remaining hydrocarbon diluent. This distillation step is critical for effectively reducing the hydrocarbon content (which includes the diluent) remaining in the separated fines. While some hydrocarbons will azeotropically distill (water and diluent distill as one phase and at one temperature), other diluents will be effectively distilled off as they boil at a temperature lower than the water (i.e. lower then 212° F.). Through this distillation the diluent can be effectively and substantially completely removed from the fines, with the resultant hydrocarbon content of the treated fines being generally less than 5% by weight, preferably less than 2% by weight, and optimally less than 0.5% by weight of the treated fines.

Following distillation when there is excess water the fines are then separated out. This separation can also be carried out by any one of a number of processes including settling tanks, centrifuges and cyclones, but the preferable separation is carried out by filtration.

The resultant treated fines in general have a catalyst fines content of at least about 55% by weight, a hydrocarbon content of up to about 5% by weight and a water content of up to 40% by weight and wherein at least 95% by weight of the cat cracker bottoms hydrocarbons have been removed from the sludge. Preferably, the resultant treated fines have a catalyst fines content of at least about 65% by weight, a hydrocarbon content of up to 2% by weight, and a water content of up to 35% by weight and wherein at least 99% by weight of the cat cracker bottoms hydrocarbons have been removed from the sludge. These treated fines can then be economically and environmentally safely disposed of as by landfilling, or the catalyst fines may even be recycled to the cat cracking reactor.

The various liquid fractions, removed upon separation and distillation, are then processed to recover and isolate from each other the water, the diluent, and the cat cracker bottoms hydrocarbons. The isolation of the liquid components can be carried out by any one of a number of known procedures. The aqueous solution-diluent fraction can be decanted to separate the diluent from the water. The diluent-cat cracker bottoms fraction can be fractionated to remove the diluent from the cat cracker bottoms. The diluent and water may then be recycled to provide an economically sound process and the cat cracker bottom hydrocarbons may be blended into a fuel, or used for carbon black feedstock.

EXAMPLE I

Cat cracker bottoms from a cat cracking operation are fed into a settling tank to settle the solids (catalyst fines) into a sludge containing 20% by weight ash and 80% by weight cat cracker bottoms.

The sludge is mixed with n-heptane (boiling point 209° F.) at a 1:1 by weight ratio of n-heptane to cat cracker bottoms in the sludge, with mixing being carried out for two hours at 190° F. in a mixing tank. The mixture is then filtered hot to separate the fines (cake), followed by washing the separated fines (cake) with n-heptane at 190° F. at a by weight ratio of 0.5:1 of n-heptane to cat cracker bottoms in the original sludge. The free n-heptane is then drained off.

The separated fines and remaining n-heptane (cake) are sluiced off the filter with water into a slurry tank forming a slurry containing a by weight ratio of 3.5:1 of water to separated fines and remaining n-heptane (cake). The remaining n-heptane is removed by boiling (distilling) off the n-heptane-water azeotrope which has a boiling point of 182° F. The resultant fines-water slurry is filtered, with water being recycled.

The treated fines then are disposed by landfilling, with the treated fines containing by weight about 71% catalyst fines, about 27% water and about 2% hydrocarbons, and wherein greater than 99% of the cat cracker bottoms hydrocarbons are removed from the sludge. The n-heptane and the cat cracker bottoms hydrocarbons are recovered and isolated from each other in a steam stripper tower with reboiler, with the n-heptane and water streams being isolated from each other by decanting. Subsequently the water and n-heptane are recycled into the process, with the cat cracker bottoms hydrocarbons being used in other products.

EXAMPLE II

Cat cracker bottoms from a cat cracking operation are fed into a settling tank to settle the solids (catalyst fines) into a sludge containing 20% by weight ash and 80% by weight cat cracker bottoms.

The sludge is mixed with n-heptane (boiling point 209° F.) at a 1:1 by weight ratio of n-heptane to cat cracker bottoms in the sludge, with mixing being carried out for two hours at 190° F. in a mixing tank. The mixture is then filtered hot to separate the fines (cake), followed by washing the separated fines (cake) with n-heptane at 190° F. at a by weight ratio of 0.5:1 of n-heptane to cat cracker bottoms in the original sludge. The free n-heptane is then drained off.

Steam is then introduced through the separated fines and remaining n-heptane (cake) at a by weight ratio of 1:10 of steam to separated fines and remaining n-heptane (cake), which heats the fines at the same time water is added to the fines by condensation of the steam. The heat imparted by the steam distills off the remaining n-heptane as a n-heptane-water azeotrope which has a boiling point of 182° F.

The treated fines then are disposed by landfilling, with the treated fines containing by weight about 63% catalyst fines, about 35% water and about 2% hydrocarbons, and wherein greater than 98% of the cat cracker bottoms hydrocarbons are removed from the sludge. The n-heptane and the cat cracker bottoms hydrocarbons are recovered and isolated from each other in a steam stripper tower with reboiler, with the n-heptane and water streams being isolated from each other by decanting. Subsequently the water and n-heptane are recycled into the process, with the cat cracker bottoms hydrocarbons being used in other products.

What is claimed is:

1. A process for treating cat cracker bottoms sludge to remove the cat cracker bottoms hydrocarbons from the catalyst fines in the sludge which comprises:

mixing the cat cracker bottoms sludge with a liquid hydrocarbon diluent selected from the group consisting of heptane, benzene and toluene which have azeotropic boiling points with water of 150° F. to 210° F.;

separating the fines from the diluent-sludge mixture by filtration and washing the fines with additional diluent in an amount of 20% to 500% by weight of said hydrocarbons in said sludge;

mixing the separated fines and remaining diluent with water in an amount of 250% to 700% by weight of said separated fines and diluent remaining in said fines said mixing being conducted at a temperature below the boiling point of the diluent and within the range of ambient of 210° F.; and removing the remaining diluent by distillation of the fines, diluent and water to obtain the treated fines which have a hydrocarbon content of less than 5% by weight.

2. Process of claim 1 further comprising prior to mixing the sludge with diluent, concentrating the catalyst fines in the cat cracker bottoms by settling the fines and drawing off the cat cracker bottoms hydrocarbons.

3. Process of claim 2 wherein the cat cracker bottoms sludge has an ash content of about 10% to 40% by weight and a hydrocarbon content of about 60% to 90% by weight.

4. Process of claim 3 wherein the treated fines have a catalyst fines content of at least about 55% by weight, a hydrocarbon content of up to 5% by weight, and a water content of up to about 40% by weight, and wherein at least 95% by weight of the cat cracker bottoms hydrocarbons are removed from the sludge.

5. Process of claim 4 wherein the diluent is heptane.

6. Process of claim 5 further comprising separating the fines from the water slurry after distillation.

7. Process of claim 6 wherein the fines are separated from the water slurry by filtration.

8. Process of claim 5 wherein the diluent when combined with water has a boiling point within the range of 150° F. to 210° F.

9. Process of claim 5 further comprising adding an antifoaming agent to the slurry.

10. Process of claim 1 wherein the water in the form of steam is mixed with the separated fines and remaining diluent.

11. Process of claim 10 wherein the amount of steam is within the range of 3% to 25% by weight of the separated fines and remaining diluent.

12. Process of claims 6 or 11 wherein the treated fines have a catalyst fines content of at least about 65% by weight, a hydrocarbon content of up to about 2% by weight and a water content of up to 35% by weight, and wherein at least 99% by weight of the cat cracker bottoms hydrocarbons are removed from the sludge.

13. Process of claim 12 wherein the diluent is selected from the group consisting of n-heptane and toluene.

14. Process of claim 1 further comprising adding a separation aid to the diluent-sludge mixture which accelerates separation of the fines.

15. Process of claim 1 further comprising prior to mixing the sludge with the diluent, concentrating the catalyst fines in the cat cracker bottoms sludge by dielectrophoretic separation.

16. Process of claim 1 further comprising recovering and isolating from each other the water, the diluent, and the cat cracker bottoms hydrocarbons which were separated and distilled from the fines.

* * * * *